US009642444B2

(12) United States Patent
Krol

(10) Patent No.: US 9,642,444 B2
(45) Date of Patent: May 9, 2017

(54) BODY HARNESS DEVICE

(71) Applicant: Henryk Krol, Chicago, IL (US)

(72) Inventor: Henryk Krol, Chicago, IL (US)

( * ) Notice: Subject to any disclaimer, the term of this patent is extended or adjusted under 35 U.S.C. 154(b) by 0 days.

(21) Appl. No.: 14/686,149

(22) Filed: Apr. 14, 2015

(65) Prior Publication Data

US 2015/0305478 A1 Oct. 29, 2015

Related U.S. Application Data

(60) Provisional application No. 61/984,941, filed on Apr. 28, 2014.

(51) Int. Cl.

| | |
|---|---|
| ***A45F 3/04*** | (2006.01) |
| ***A45F 3/14*** | (2006.01) |
| ***A45F 5/02*** | (2006.01) |

(52) U.S. Cl.

CPC ..... *A45F 3/14* (2013.01); *A45F 5/021* (2013.01); *A45F 2003/142* (2013.01); *A45F 2003/146* (2013.01); *A45F 2200/0575* (2013.01)

(58) Field of Classification Search

CPC ..... A45F 2003/146; A45F 2003/142; A45F 3/14; A45F 2003/045; A45F 3/04; A45F 3/08; A62B 35/006; A62B 35/0018; A62B 35/0031

USPC ..... 224/262, 259–260, 646, 647, 250

See application file for complete search history.

(56) References Cited

U.S. PATENT DOCUMENTS

| | | | | | |
|---|---|---|---|---|---|
| 5,163,591 | A * | 11/1992 | Leiserson | A45F 5/02 | 224/148.6 |
| 5,184,764 | A * | 2/1993 | Orovan | A45F 3/08 | 224/262 |
| 5,385,281 | A * | 1/1995 | Byrd | A41D 13/04 | 2/51 |
| 5,915,606 | A * | 6/1999 | Jensen | A45F 3/14 | 224/148.6 |
| 5,943,696 | A | 8/1999 | Walker | | |
| 5,961,014 | A * | 10/1999 | Knerr | A45F 3/04 | 224/153 |
| 5,988,315 | A * | 11/1999 | Crane | A45F 5/00 | 182/3 |
| 6,648,191 | B2 * | 11/2003 | Giggleman | A45F 3/14 | 224/254 |
| 6,698,631 | B1 * | 3/2004 | Haskins | A45F 3/14 | 224/148.4 |
| 6,719,178 | B1 | 4/2004 | Taylor | | |

(Continued)

*Primary Examiner* — Adam Waggenspack

(74) *Attorney, Agent, or Firm* — Global Intellectual Property Agency, LLC; Daniel Boudwin

(57) ABSTRACT

A body harness device for carrying a container and supporting a variety of tools thereon. The device includes a harness having a belt adjustably secured to a first shoulder strap and a second shoulder strap. The device further includes a container strap that is removably secured between the front sections of the shoulder straps. The belt and shoulder straps include fasteners, such as clips, hooks, magnets, and D-rings, for attaching a variety of tools to the harness. In this way, a user reduces the amount of trips needed in order to obtain necessary tools for painting and the like, while allowing the tools to be conveniently accessed. The device further allows the user to carry the tools and container hands-free, therefore enabling the user to hold himself or herself in a stable position while on a ladder, scaffold, rooftop and the like.

12 Claims, 5 Drawing Sheets

(56) References Cited

U.S. PATENT DOCUMENTS

| | | | | |
|---|---|---|---|---|
| 7,631,728 | B2 * | 12/2009 | Hill | A62B 35/0018 182/3 |
| 8,516,621 | B2 * | 8/2013 | Woolery | A41D 13/0012 2/300 |
| 9,027,707 | B2 * | 5/2015 | Schierenbeck | A62B 35/00 182/3 |
| 2003/0052144 | A1 * | 3/2003 | Vardi | A45F 3/14 224/258 |

* cited by examiner

BODY HARNESS DEVICE

CROSS REFERENCE TO RELATED APPLICATION

This application claims the benefit of U.S. Provisional Application No. 61/984,941 filed on Apr. 28, 2014. The above identified patent application is herein incorporated by reference in its entirety to provide continuity of disclosure.

BACKGROUND OF THE INVENTION

Field of the Invention

The present invention relates to body harness devices. More specifically, the present invention provides a harness comprising a first shoulder strap and a second shoulder strap, wherein the shoulder straps are adjustably secured to a belt. The belt and shoulder straps are adjustable and include a pair of front couplings and a pair of rear couplings. Each coupling allows the shoulder straps to be adjusted in length in order to fit the size of the user. The device further includes a container strap that is removably secured between the front of the first shoulder strap and second shoulder strap. The device further comprises a plurality of fasteners, such as clips, hooks, magnets, and D-rings, for attaching a variety of tools thereto.

Working on rooftops, scaffolds, ladders and the like can be a dangerous task due to the risk of falling. Furthermore, when climbing or even walking on such apparatuses, a person needs to use both hands in order to stabilize and secure themselves. Therefore, it is difficult to carry the necessary tools while on rooftops, scaffolds, ladders, and the like when performing tasks, such as painting. Not only does a person need to carry tools when painting, such as paint brushes and painter's tape, but a paint bucket is also required. However, it is dangerous and very difficult to carry these necessary tools, unless multiple trips are made to retrieve the tools or paint bucket. Unfortunately, traveling repeatedly up and down a ladder or across a rooftop to retrieve such tools introduces additional risk of injury and is time consuming. Quick and convenient access to tools and other objects is helpful in efficiently completing a task, such as painting. Therefore, there is a need for a device that provides a person with convenient access to tools, and the like, while providing the ability to carry such items hands-free.

Devices have been disclosed in the prior art that relate to body harness devices. These include devices that have been patented and published in patent application publications. These devices generally relate to a belt or harness that supports a container of liquid or paint. These devices include U.S. Pat. No. 5,163,591 to Leiserson and Hardy, U.S. Pat. No. 5,943,696 to Walker, U.S. Pat. No. 5,915,606 to Jenson, and U.S. Pat. No. 6,719,178 to Taylor. One other device, U.S. Pat. No. 8,516,621 to Woolery, relates to garments including magnets thereon adapted to magnetically secure small items thereto. These devices, however, fail to disclose a harness comprising a pair of shoulder straps adjustably secured to a belt, wherein the harness includes one or more magnetic fasteners thereon and a container strap removably secured thereto. Additionally, these devices fail to include a plurality of fasteners attached thereto as described in the presently claimed invention.

In light of the devices disclosed in the prior art, it is submitted that the present invention substantially diverges in design elements from the prior art and consequently it is clear that there is a need in the art for an improvement to existing body harness devices. In this regard the instant invention substantially fulfills these needs.

SUMMARY OF THE INVENTION

In view of the foregoing disadvantages inherent in the known types of body harness devices now present in the prior art, the present invention provides a new body harness device wherein the same can be utilized for providing convenience and safety for the user when carrying tools and a container of liquid while performing tasks, such as painting, on ladders, scaffolds, rooftops, and the like.

It is therefore an object of the present invention to provide a new and improved body harness device that has all of the advantages of the prior art and none of the disadvantages.

It is another object of the present invention to provide a body harness device comprising a harness with a first shoulder strap and a second shoulder strap adjustably secured to a belt.

It is another object of the present invention to provide a body harness device comprising a container strap removably secured between the first shoulder strap and second shoulder strap adapted to hold a container of paint therein.

Another object of the present invention is to provide a body harness device further comprising one or more magnets secured to the harness adapted to carry a variety of magnetic tools thereon.

Yet another object of the present invention is to provide a body harness device further comprising a plurality of fasteners thereon adapted to carry a variety of tools.

Another object of the present invention is to provide a body harness device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
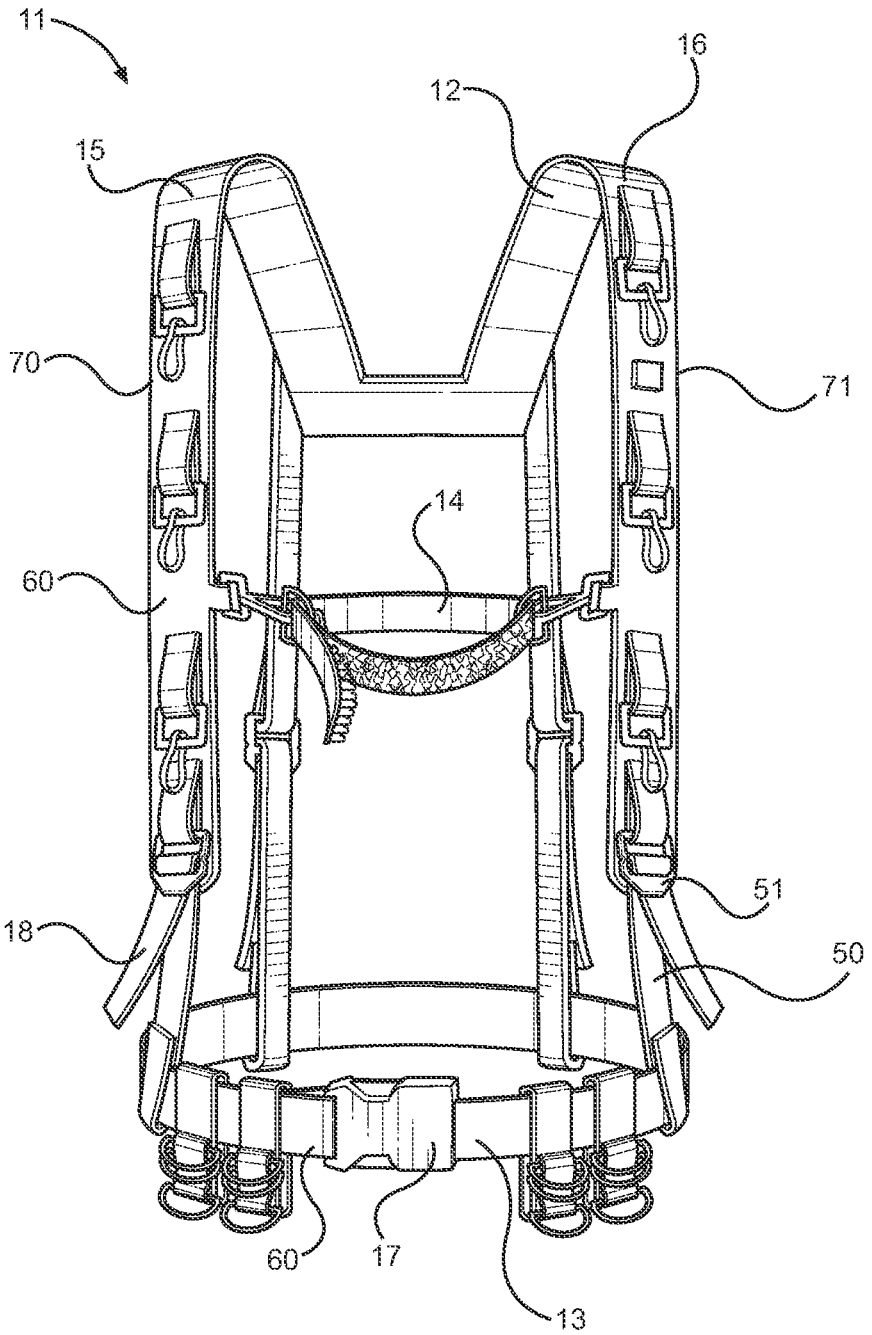
FIG. 1 shows a perspective view of the front of an embodiment of the body harness device.

Reference is made herein to the attached drawings. Like reference numerals are used throughout the drawings to depict like or similar elements of the body harness device.

For the purposes of presenting a brief and clear description of the present invention, the preferred embodiment will be discussed as used for carrying a container of paint and attaching a variety of painter's tools thereon. The figures are intended for representative purposes only and should not be considered to be limiting in any respect.

Figure 2:
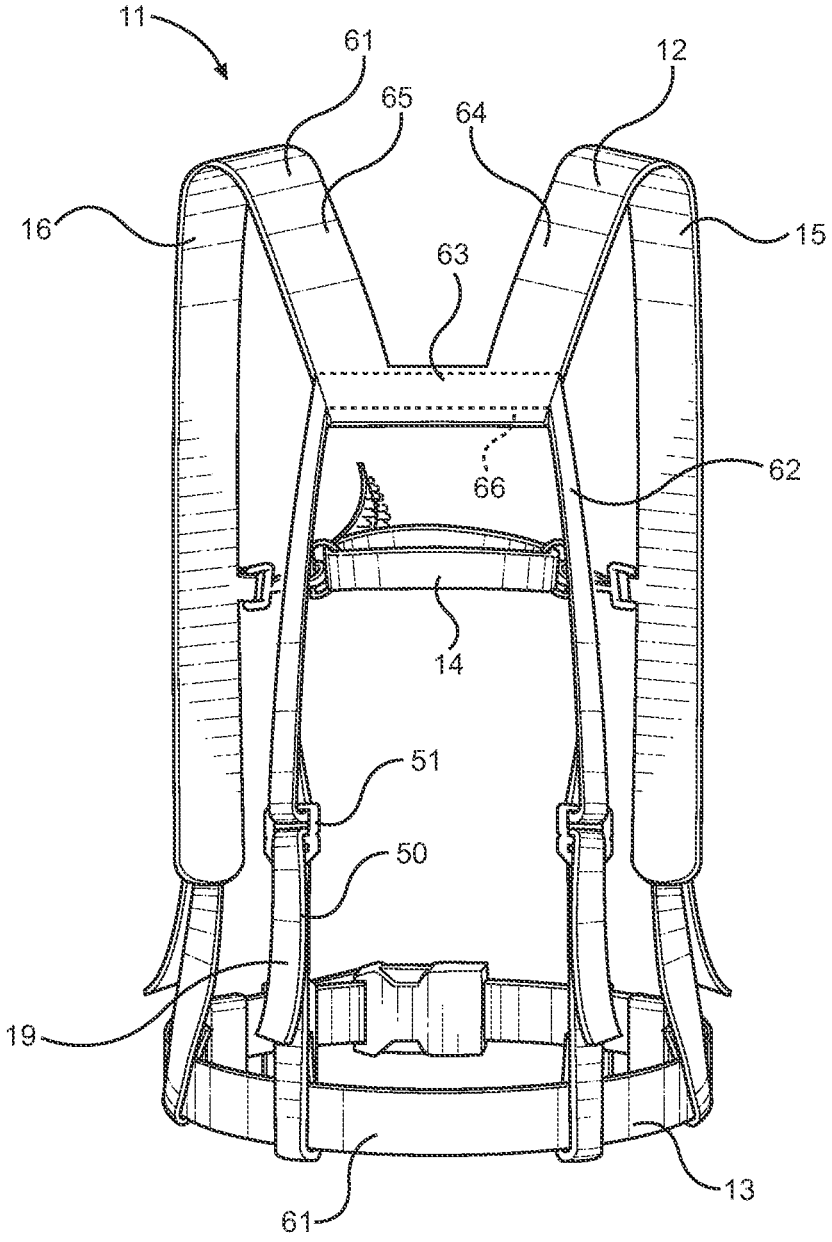
FIG. 2 shows a perspective view of the rear of an embodiment of the body harness device.

Referring now to FIGS. 1 and 2, there is shown a perspective view of the front of an embodiment of the body harness device and a perspective view of the rear of an embodiment of the body harness device, respectively. The device 11 comprises a harness 12 that comprises a first shoulder strap 15 and a second shoulder strap 16 adjustably secured to a belt 13. The belt 13 and shoulder straps 15, 16 each comprise a front section 60 and a rear section 61, wherein the front section 60 is adapted to fit over the chest and front torso of a user and the rear 61 is adapted to fit over the back and rear torso of the user. The device 11 further comprises a pair of front couplings 18 and a pair of rear couplings 19 adapted to adjust the length of the shoulder straps 15, 16 and adjustably secure the belt 13 thereto. The front section 60 and rear section 61 of the shoulder straps 15, 16 are independently adjustable in length in order to maintain the desired position of the body harness device 11 when worn by a user.

Each coupling 18, 19 comprises an elongated strap 50 and a buckle 51. The elongated strap 50 includes a first end and a second end, wherein the first end extends upward from the belt 13 and the second end connects to the buckle 51, wherein the buckle 51 is secured to the end of a shoulder strap 15. The buckle 51 allows the elongated strap 50 to connect thereto at various lengths, such that the length of the shoulder straps can be adjusted. The first end of the elongated strap 50 is attached to the belt 13 by any suitable fastener, such as stitching or hook and loop material. In some embodiments, the front and rear couplings 18, 19 are removably secured to the belt 13, thereby allowing the user to adjust the position of the shoulder straps 15, 16 relative to the belt 13.

The belt 13 is an elongated, flexible strap adapted to be worn around a person's torso, wherein the ends are removably secured together by any suitable belt fastener 17, such as a buckle. The belt fastener 17 is adapted to secure the body harness device 11 to a user. The belt fastener 17 is disposed on the front section 60 of the belt 13 allowing a user to conveniently unfasten or secure the body harness device 11. In some embodiments, the length of the belt 13 is adjustable.

The shoulder straps 15, 16 are elongated and flexible, wherein each strap 15, 16 extends from a front coupling 18 to a rear couplings 19. A first front coupling 18 and the first shoulder strap 15 connected thereto are positioned parallel to a second front coupling 18 and the second shoulder strap connected thereto. The first front coupling 18 is disposed on one side of the front section 60 of the belt 13 and the second front coupling 18 is disposed on the opposite side of the front section 60 of the belt 13. The pair of rear couplings 19 are parallel to each other, wherein a first rear coupling 19 is disposed on one side of the rear section 61 of the belt 13 and the second rear coupling 19 is disposed on the opposite side of the rear section 61 of the belt 13. In this way, one side 70 of the body harness device 11 is a mirror image of the opposing side 71 of the body harness device 11. The belt 13 and shoulder straps 15, 16 are composed of any suitable material, such as webbing or leather.

The rear section 61 of the shoulder straps 15, 16 include a pair of vertical straps, a horizontal member 63, and a flexible strap 62 that attaches to the rear couplings. The pair of vertical straps 15, 16 are a continuation of the independent shoulder straps 15, 16 from the front section 60 of the body harness device 11. A first vertical strap 15 connects to a second vertical strap 16 by a horizontal member 63, wherein the horizontal member 62 is disposed between and is substantially perpendicular to the pair of vertical straps 15, 16. The horizontal member 63 includes a channel 66 therethough providing access for the flexible strap 62 to fit therethrough. The flexible strap 62 is disposed through the channel 66 of the horizontal member 63, wherein the ends of the flexible strap 62 are suspended therefrom and are adjustably secured to the pair of rear couplings 19. In this way, the rear of the harness provides additional back support and prevents the shoulder straps 15, 16 from falling off the shoulders in operation. The end of the shoulder straps 15, 16 comprise the ends of the flexible strap 62.

The device 11 further includes a container strap 14 removably secured to the front section 60 of the shoulder straps 15, 16, wherein the container 14 strap is positioned therebetween. The container strap 14 is adapted to hold upright a container therein. The container strap 14 is configured in a loop adapted to be positioned around the exterior of a container or paint can. The container strap 14 includes a first end and a second end, wherein the first end removably secures to the second end using any suitable fastener, such as hook and loop material, thereby forming a loop configuration. In this way, the container strap 14 is adjustable, thereby allowing various sized containers to fit therein. The container strap 14 rests between the front shoulder straps 15, 16, wherein the first side of the loop formed by the container strap 14 removably secures to the front section 60 of the first shoulder strap 15 and the second side of the loop removably secures to the front section 60 of the second shoulder strap 16 by any suitable fastener, such as a clip. In this way, the container strap 14 is adapted to form a loop around a container, securing the container therein and allowing the container to rest on the front of a user's body.

Figure 3:
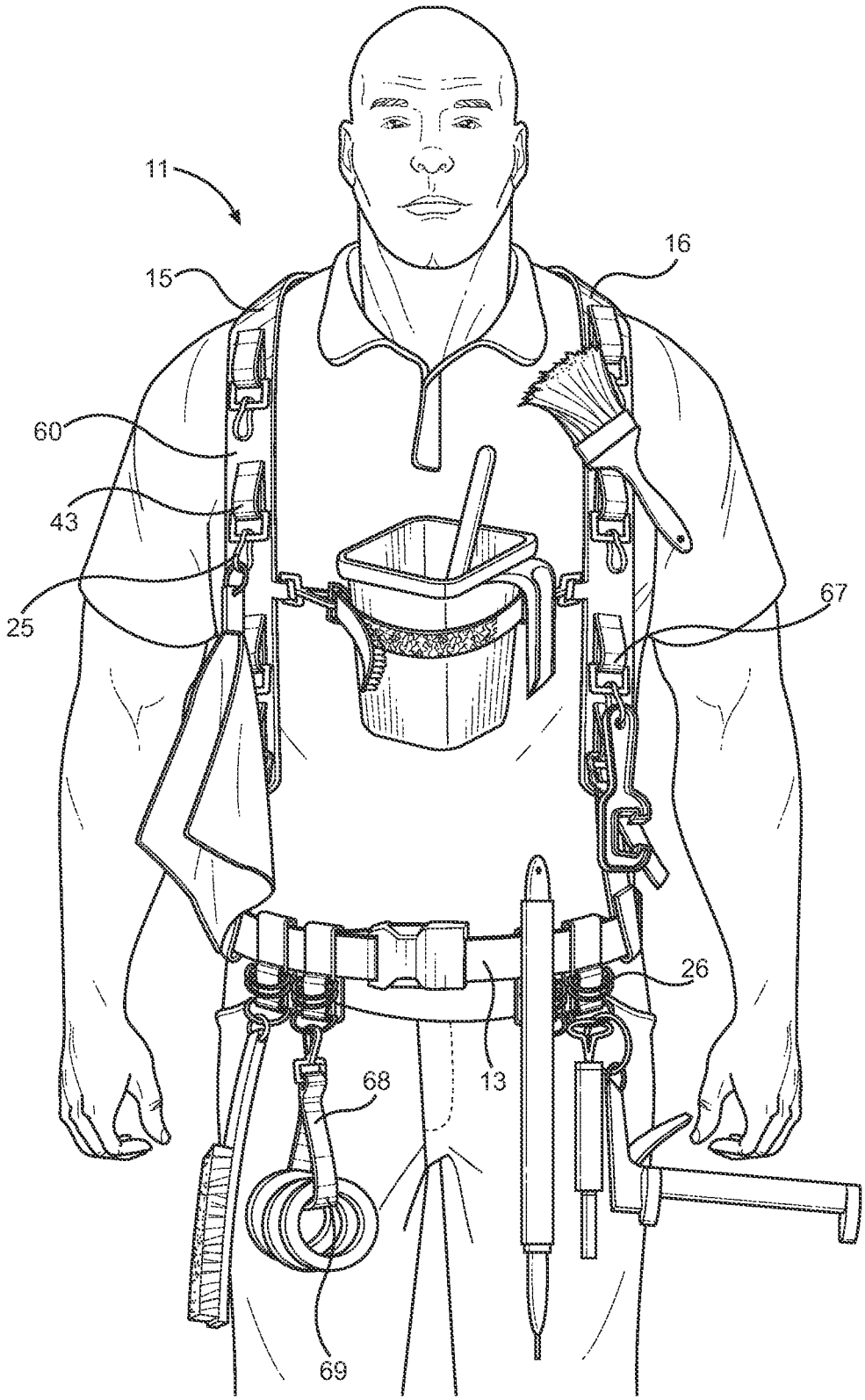
FIG. 3 shows a perspective view of the front of a user wearing an embodiment of the body harness device with a variety of tools attached thereon.
Figure 4:
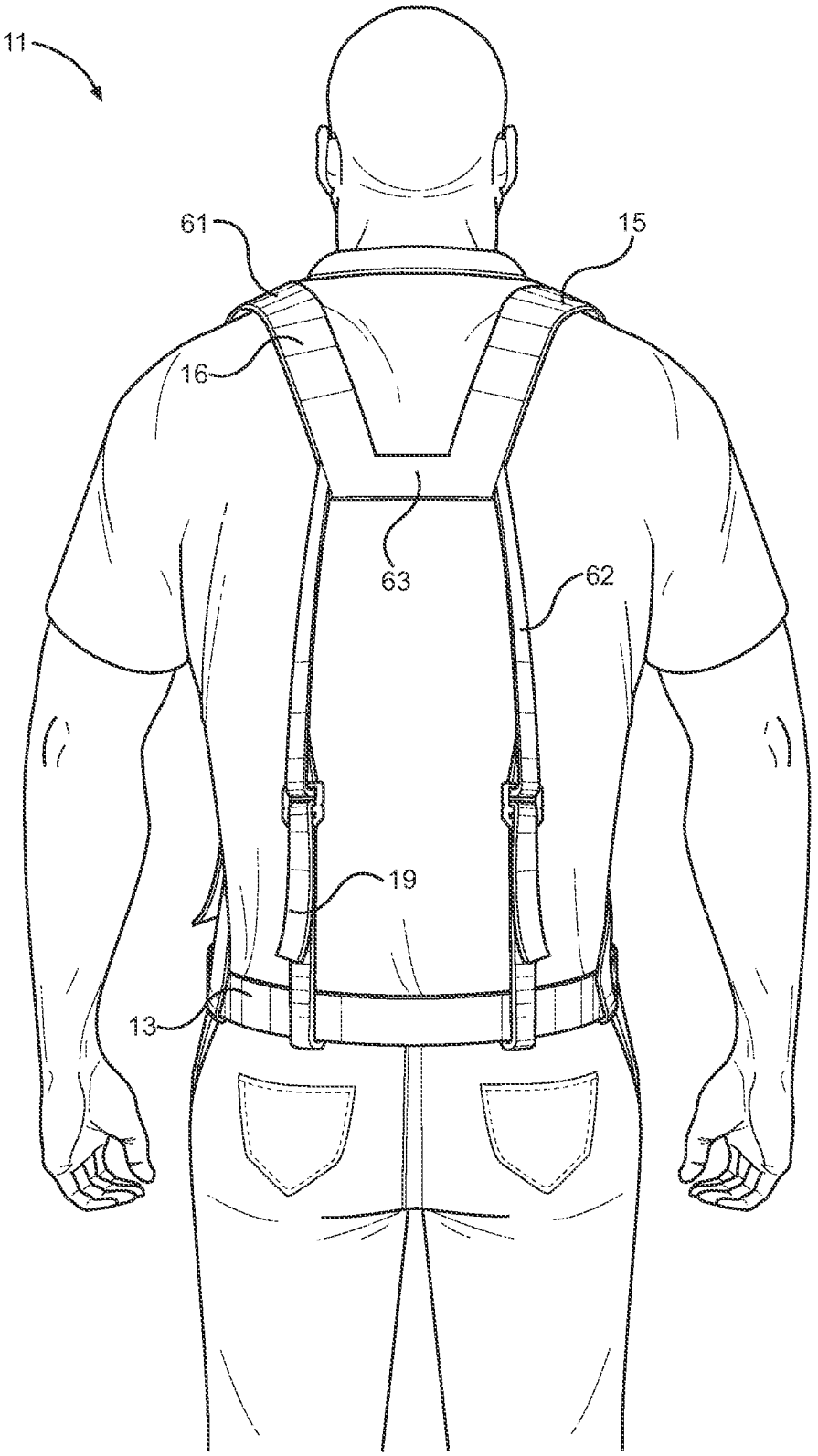
FIG. 4 shows a perspective view of the rear of a user wearing an embodiment of the body harness device with a variety of tools attached thereon.

Referring now to FIGS. 3 and 4, there is shown a perspective view of the front of a person wearing an embodiment of the body harness device and a perspective view of the rear of a person wearing an embodiment of the body harness device, respectively, with a variety of tools attached thereon. When the body harness device 11 is worn by a user, the belt 13 is positioned around a user's torso, wherein the pair of front couplings 18 extend vertically upwards therefrom and connect to the ends of the front section 60 of the shoulder straps 15, 16. The shoulder straps 15, 16 extend vertically across a user's chest, over their shoulders, and down across his or her back, wherein the rear section 61 of the shoulder straps 15, 16 connect to the rear couplings 19. The pair of rear couplings 19 extend vertically downward from the ends of the flexible strap shaped strap 62 of the rear section 61 of the shoulder straps 15, 16 and attach to the rear section 61 of the belt 13. The horizontal member 63 is positioned near the center of the user's back, thereby providing support thereto and preventing the shoulder straps 15, 16 from slipping off the user's shoulders.

The body harness device 11 comprises a plurality of fasteners 67 disposed on the belt 13 and shoulder straps 15, 16 adapted to hold a variety of tools thereon, such as a caulking gun, a dust brush, and an extension pole. Such fasteners 67 include clips 25, buckles, hooks, D-rings 26, hook and loop material, among others. The fasteners 67 are attached to the belt 13 and shoulder strap 15 by a retaining strap 43. However, in other embodiments, the fasteners attach directly to the belt 13 and shoulder straps 15, 16. The retaining strap 43 is attached to the body harness device 11 by any suitable means, such as stitching, and includes a channel adapted secure the fastener 67 thereto. The retaining straps 43 are flat so as to provide less bulkiness to the device 11. In an alternative embodiment of a fastener 68, a fastener 68 is removably secured to the body harness device 11, whereby a fastening strap 69 is attached thereto. In this way, the device 11 is adapted to carry bulkier objects, such as painter's tape, that otherwise could not be attach to the body harness device 11. The device 11 further includes one or more magnets 24 adapted to removably attach a variety of magnetic tools thereon, such as a paint brush. The magnets are attached to the device by any suitable fastener, such as adhesives or rivets.

Figure 5:
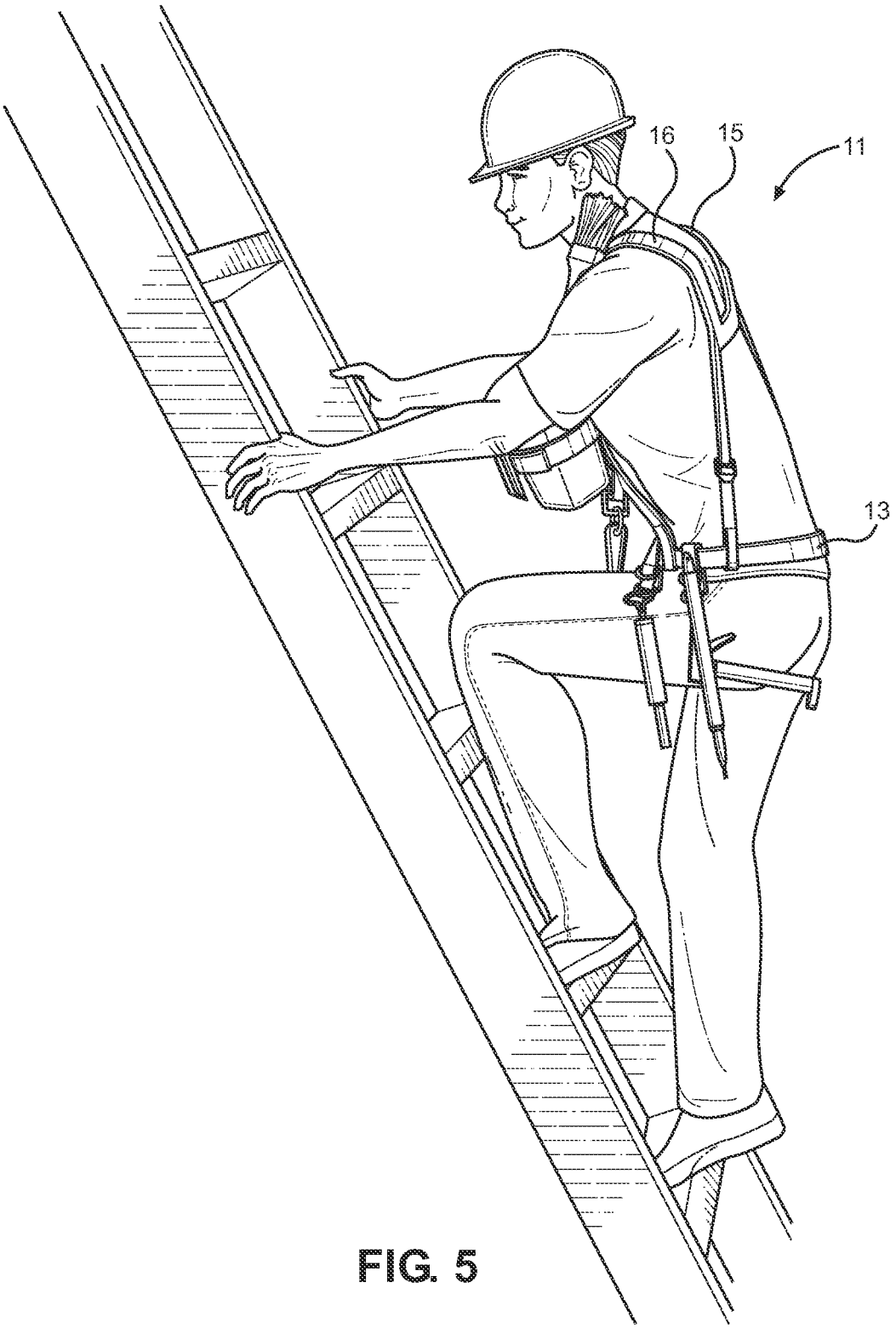
FIG. 5 shows a perspective view of an embodiment of the body harness device in use.

Referring now to FIG. 5, there is shown a perspective view of an embodiment of the body harness device in use. In operation, the shoulder straps 15, 16 are attached to the belt 13 and adjusted to the desired shoulder strap 15 length. The user positions his or her arms through each shoulder strap 15, 16 and removably secures the belt 13 around his or her torso. Once the body harness device 11 is fastened, the user chooses the variety of tools to fasten thereon. The user is free to use his or her hands while carrying a variety of tools on the body harness device 11, thereby able to maintain a stable position while on a ladder, scaffold, rooftop and the like.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body harness device, comprising:

a first shoulder strap and a second shoulder strap;

a belt removably secured to said first shoulder strap and said second shoulder strap of said harness;

a container strap extending between said first shoulder strap and said second shoulder strap adapted to support a container therein;

wherein said first shoulder strap and said second shoulder strap comprise a front section and a rear section, wherein said rear section of said first shoulder strap and said second shoulder strap comprise a pair of vertical straps, a flexible strap, and an elongated horizontal member having a channel extending therethrough along the entire horizontal length of the horizontal member, wherein said pair of vertical straps are a continuation of said front section of said first shoulder strap and said second shoulder strap, wherein said pair of vertical straps extend therefrom and are connected by said horizontal member disposed therebetween, wherein said flexible strap is disposed through said channel of said horizontal member, wherein each end of said flexible strap is attached to said belt directly below the horizontal member and said end of said rear section of said first shoulder strap and said rear section of said second shoulder strap.

2. The body harness device of claim 1, one or more magnets secured to said harness adapted to removably attach tools thereon.

3. The body harness device of claim 1, wherein said container strap forms a loop adapted to support a container therein, wherein a first side of said loop is removably secured to said first shoulder strap and said second side of said loop is removably secured to said second shoulder strap.

4. The body harness device of claim 3, wherein said container strap comprises a first end and a second end, wherein said first end removably secures to said second end by a fastener, such that a length of said loop formed by said container strap is adjustable.

5. The body harness device of claim 1, wherein said belt is adjustably secured to said first shoulder strap and said second shoulder strap by a pair of front couplings and a pair of rear couplings each having a first end and a second end, wherein said first end is secured to said belt and said second end is adjustably secured to an end of a shoulder strap.

6. The body harness device of claim 5, wherein said pair of front couplings and said pair of rear couplings each comprise an elongated strap and a buckle, wherein said elongated strap includes a first end and a second end, wherein said first end of said elongated strap extends upward from said belt and said second end is adjustably secured to said buckle, wherein said buckle is secured to said end of said shoulder strap.

7. The body harness device of claim 1, wherein said front section of said first shoulder strap is parallel to said front of said second shoulder strap, wherein said front section of said first shoulder strap and said front section of said second shoulder strap are adapted to extend vertically from said belt across a user's chest and over a user's shoulders.

8. The body harness device of claim 1, further comprising a plurality of fasteners secured to said belt and said harness adapted to removably attach tools thereon.

9. The body harness device of claim 1, further comprising a plurality of fasteners removably secured to said belt and said harness adapted to removably attach tools thereon.

10. The body harness device of claim 8, wherein said fasteners comprising at least one of clips, buckles, hooks, D-rings, and hook and loop material.

11. The body harness device of claim 1, wherein said belt includes a first end removably secured to a second end by a belt fastener.

12. The body harness device of claim 1, wherein said belt fastener is a buckle.

* * * * *